US012065181B2

(12) United States Patent
Spencer et al.

(10) Patent No.: US 12,065,181 B2
(45) Date of Patent: Aug. 20, 2024

(54) TAMPERPROOF GATE MECHANISM

(71) Applicant: Siemens Mobility, Inc., New York, NY (US)

(72) Inventors: Daniel Spencer, Pittsburgh, PA (US); Brian Joseph Hogan, Temecula, CA (US); Richard C. Bohme, Louisville, KY (US)

(73) Assignee: Siemens Mobility, Inc., New York, NY (US)

( * ) Notice: Subject to any disclaimer, the term of this patent is extended or adjusted under 35 U.S.C. 154(b) by 482 days.

(21) Appl. No.: 17/278,696

(22) PCT Filed: Nov. 13, 2019

(86) PCT No.: PCT/US2019/061136
§ 371 (c)(1),
(2) Date: Mar. 23, 2021

(87) PCT Pub. No.: WO2020/102317
PCT Pub. Date: May 22, 2020

(65) Prior Publication Data

US 2022/0041195 A1 Feb. 10, 2022

Related U.S. Application Data

(60) Provisional application No. 62/767,081, filed on Nov. 14, 2018.

(51) Int. Cl.
*B61L 29/00* (2006.01)
*B61L 29/04* (2006.01)
*B61L 29/10* (2006.01)

(52) U.S. Cl.
CPC ..... *B61L 29/10* (2013.01); *B61L 29/04* (2013.01)

(58) Field of Classification Search
CPC ..... B61L 29/10; B61L 29/04
See application file for complete search history.

(56) References Cited

U.S. PATENT DOCUMENTS 827,772 A 8/1906 Worland
2,401,275 A * 5/1946 Richards ..... B61L 29/04 49/152

(Continued)

FOREIGN PATENT DOCUMENTS

DE 3743348 A1 6/1989
DE 102012017627 A1 3/2014

(Continued)

OTHER PUBLICATIONS

PCT International Search Report and Written Opinion of International Searching Authority mailed Feb. 28, 2020 corresponding to PCT International Application No. PCT/US2019/061136 filed Nov. 13, 2019.

(Continued)

*Primary Examiner* — Daniel J Troy
*Assistant Examiner* — Daniel Alvarez

(57) ABSTRACT

A crossing gate mechanism (300) includes a linkage (320) operably coupled to a crossing gate arm (310), wherein the crossing gate arm (310) is movable between a vertical position (VP) and a horizontal position (HP) via the linkage (320), wherein the linkage (320) is in a first position when the crossing gate arm (310) is in the vertical position (VP) and in a second position when the crossing gate arm (310) is in the horizontal position (HP), and wherein the linkage (320) in the second position mechanically locks the crossing gate arm (310) in the horizontal position (HP).

7 Claims, 2 Drawing Sheets

(56) References Cited

U.S. PATENT DOCUMENTS

| | | | | |
|---|---|---|---|---|
| 6,212,825 | B1 * | 4/2001 | Hopkins, Jr. | E01F 13/06 49/358 |
| 9,272,721 | B2 * | 3/2016 | Bohme | B61L 29/10 |
| 2014/0312178 | A1 * | 10/2014 | Bohme | B61L 29/10 246/125 |

FOREIGN PATENT DOCUMENTS

| | | | | |
|---|---|---|---|---|
| NL | 1011461 | C1 | 9/2000 | |
| WO | WO-2006092283 | A1 * | 9/2006 | B61L 29/04 |

OTHER PUBLICATIONS

Reichsbahnoberrat Buddenberg, "Die Reichsbahnschranke", Jan. 1, 1936, pp. 1-40, Verlag: Dr. Arthur Tetzlaff, Berlin-Friedenau.

* cited by examiner

TAMPERPROOF GATE MECHANISM

BACKGROUND

1. Field

Aspects of the present disclosure generally relate to a tamperproof gate mechanism, for example for use in connection with railroad grade crossings and railroad crossing warning devices.

2. Description of the Related Art

Warning systems have been developed to warn people and cars of an approaching train at a railroad grade crossing. Railroad grade crossings, sometimes referred to as level crossings, are locations at which railroad tracks intersect roads. A constant warning time device, also referred to as a grade crossing predictor (GCP) or a level crossing predictor, is an electronic device that is connected to the rails of a railroad track and is configured to detect the presence of an approaching train and determine its speed and distance from a railroad grade crossing. The constant warning time device, in combination with a crossing controller, will use this information to generate constant warning time signal(s) for controlling crossing warning device(s).

Crossing warning devices are devices that warn of the approach of a train at a crossing, examples of which include crossing gate arms (e.g., the familiar red and white striped wooden, fiberglass or aluminum arms often found at highway grade crossings to warn motorists of an approaching train), crossing lights (such as the red flashing lights often found at highway grade crossings in conjunction with the crossing gate arms), and/or crossing bells or other audio alarm devices. A crossing gate serves as a barrier across a highway when a train is approaching or occupying a crossing. The crossing gate is typically combined with a standard flashing light signal that provides additional warning before the arm starts to descend, while the gate arm is across the highway, and until the gate arm ascends to clearance. A gate mechanism contains mechanical and electrical devices to control the gate. The gate mechanism is either supported on the same post with the flashing light signal or separately mounted on a pedestal adjacent to the flashing light signal post.

Existing crossing gate mechanisms can be tampered with by having a pedestrian lift the gate arm(s). Lifting the gate arm(s) removes the physical barrier between the public and the rail crossing, and therefore creates an unsafe condition. This is most prevalent where there is a sidewalk arm present and due to gearing within a mechanism if a pedestrian lifts a sidewalk barrier the primary vehicle barrier will lift as well. This gives the appearance that the crossing is open/opening to vehicle traffic and is therefore unsafe.

SUMMARY

Briefly described, aspects of the present disclosure provide a gate mechanism, specifically a tamperproof gate mechanism utilized for example in railroad crossing gate applications.

A first aspect of the present disclosure provides a linkage operably coupled to a crossing gate arm, wherein the crossing gate arm is movable between a vertical position and a horizontal position via the linkage, wherein the linkage is in a first position when the crossing gate arm is in the vertical position and in a second position when the crossing gate arm is in the horizontal position, and wherein the linkage in the second position mechanically locks the crossing gate arm in the horizontal position.

A second aspect of the present provides a railroad crossing gate comprising a crossing gate arm, and a gate mechanism with a linkage operably coupled to the crossing gate arm, wherein the crossing gate arm is movable between a vertical position and a horizontal position via the linkage, wherein the linkage is in a first position when the crossing gate arm is in the vertical position and in a second position when the crossing gate arm is in the horizontal position, and wherein the linkage in the second position mechanically locks the crossing gate arm in the horizontal position.

DETAILED DESCRIPTION

To facilitate an understanding of embodiments, principles, and features of the present disclosure, they are explained hereinafter with reference to implementation in illustrative embodiments. In particular, they are described in the context of a gate mechanism, specifically a tamperproof gate mechanism utilized for example in railroad crossing gate applications.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
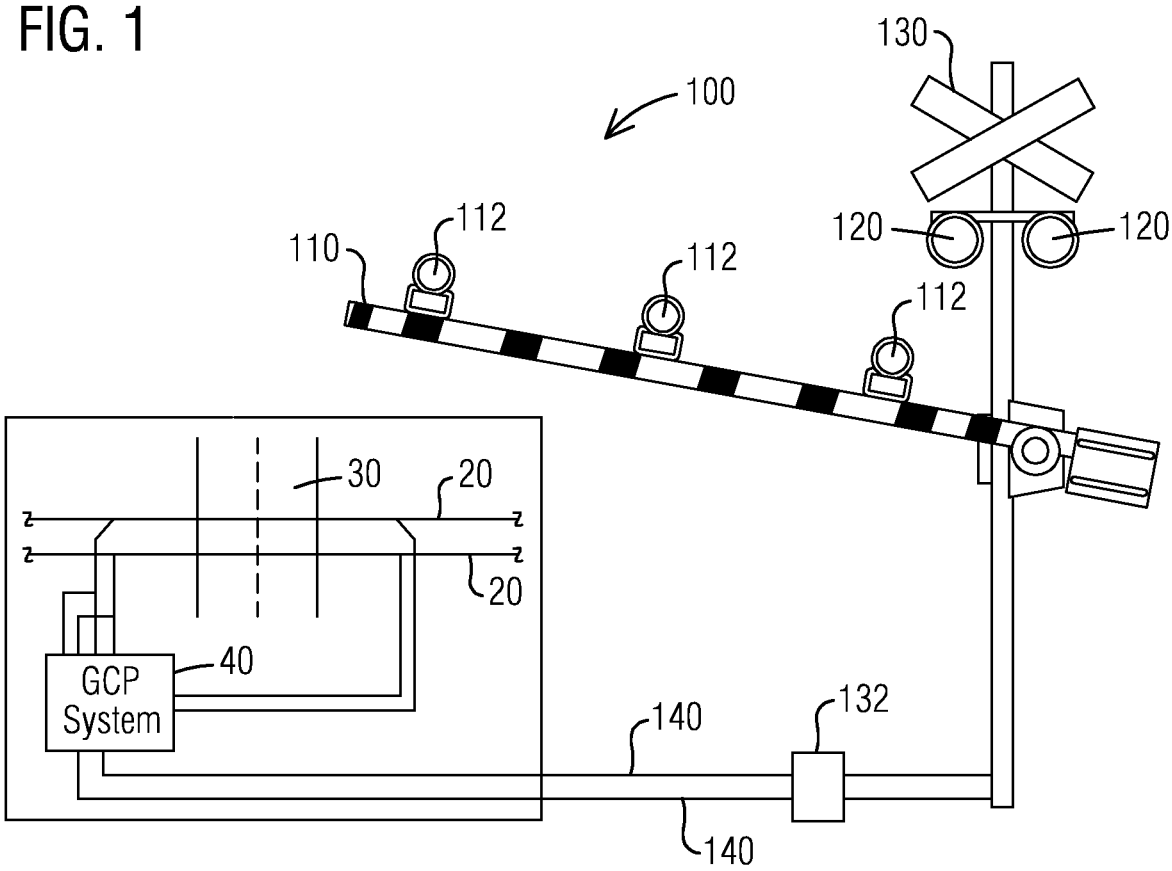
FIG. 1 illustrates an example railroad grade crossing, also referred to as level crossing, in accordance with an exemplary embodiment of the present disclosure.

FIG. 1 illustrates an example railroad grade crossing 100, also referred to as level crossing, in accordance with an exemplary embodiment of the present disclosure.

The railroad grade crossing 100 includes multiple railroad crossing warning devices, also referred to as grade crossing warning devices, which warn of an approach of a railroad vehicle, e.g. train, at the crossing of road 30 and railroad track 20. The railroad crossing warning devices include for example a crossing gate arm 110 with (or without) gate arm lights 112 spaced along the arm 110, crossing lights 120, railroad crossbuck 130, and/or other devices not illustrated herein, as for example crossing bells or other audio alarm devices. The crossing warning devices 110, 120, 130 are in communication with a constant warning time device 40, also referred to as grade crossing predictor or GCP, via connecting elements 140, which are for example electric cables. It should be noted that the components of FIG. 1 are illustrated schematically and are not drawn to scale, in particular are not drawn to scale in relation to each other.

The constant warning time device or GCP 40 is configured to detect the presence of an approaching train, determine its speed and distance from the railroad crossing, calculates when the train will arrive at the crossing, and uses this information to generate constant warning time signals for controlling the crossing warning devices 110, 120, 130. Typically, a normally energized master relay 132, only shown schematically herein, is arranged between the GCP 40 and the warning devices 110, 120, 130, for example along the connecting elements 140 and operably coupled by the connecting elements 140, wherein an output of the GCP 40 feeds a coil of the master relay 132. According to a preprogrammed time, for example a number of seconds and/or minutes, before projected arrival time of the approaching train, the GCP 40 is configured such that the output feeding the coil of the master relay 132 is turned off to drop the master relay 132 and to activate the crossing warning devices 110, 120, 130. It should be noted that the GCP 40, the master relay 132 and the warning time devices 110, 120, 130 will not be described in further detail as those of ordinary skill in the art are familiar with these devices and systems.

Figure 2:
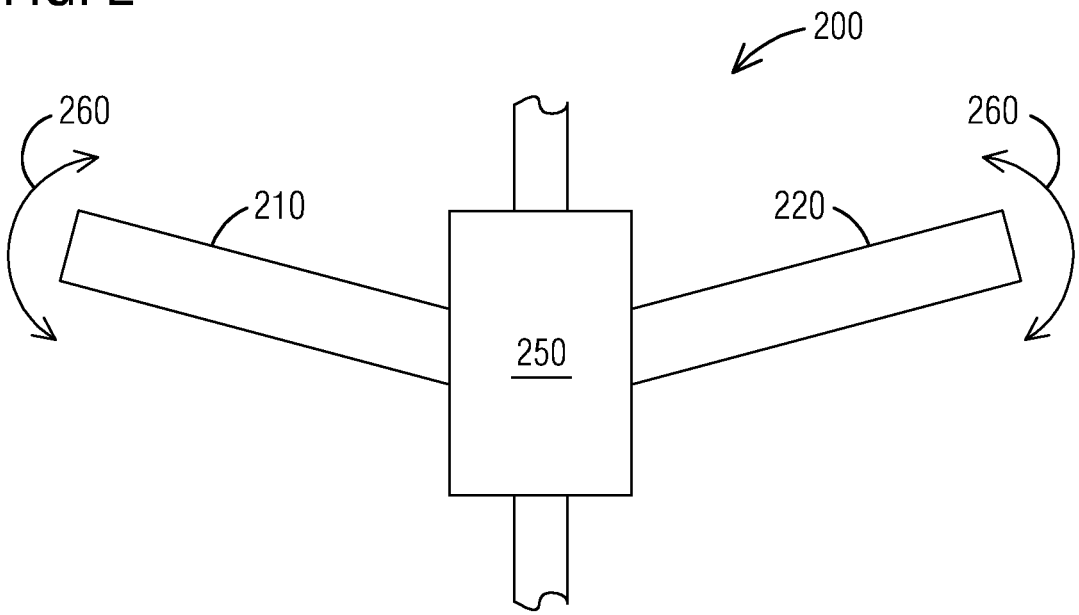
FIG. 2 illustrates a simplified view of a railroad crossing gate application with sidewalk arm in accordance with an exemplary embodiment of the present disclosure.

FIG. 2 illustrates a simplified view of a railroad crossing gate application 200 with sidewalk arm in accordance with an exemplary embodiment of the present disclosure. The railroad crossing gate application 200 is a crossing warning device and can be located at a crossing 100 as illustrated in FIG. 1, wherein the crossing warning device 110 can be configured as crossing gate 200.

The railroad crossing gate 200 comprises a first crossing gate arm 210 and a second crossing gate arm 220 which serve as barriers across a road or highway or sidewalk when a railroad vehicle, e.g. train, is approaching or occupying a crossing. The first crossing gate arm 210 can be configured as vehicle arm for roads, highways etc., and the second crossing gate arm 220 can be configured as pedestrian arm for sidewalks, or vice versa. It should be noted that the vehicle arm 210 is typically longer than the pedestrian arm 220. The gate arms 210, 220 may comprise gate arm lights spaced along the arms 210, 220.

The railroad crossing gate 200 further comprises a gate mechanism 250 for operating the crossing gate arms 210, 220. Such mechanisms 250 comprise for example a gear train in combination with an electric motor for moving the gate arms 210, 220 from a vertical position (when the gates are open) to a horizontal position (when the gates are closed). Direction of movement of the gate arms 210, 220 is illustrated by arrows 260.

Existing gate mechanisms, such as mechanism 250, can be tampered with by having a pedestrian lift the pedestrian gate arm 220 (or the vehicle arm 210). Lifting the gate arm(s) 210, 220 removes the physical barrier between the public and the grade crossing, and therefore creates an unsafe condition. This is most prevalent where there is a sidewalk arm present and due to gearing within the mechanism if a pedestrian lifts a sidewalk barrier the primary vehicle barrier will lift as well. This gives the appearance that the crossing is open or opening to vehicle traffic and is therefore unsafe.

FIG. 3, FIG. 4, FIG. 5 and FIG. 6 illustrate multiple front views of a crossing gate mechanism 300 in accordance with exemplary embodiments of the present disclosure.

Figure 3:
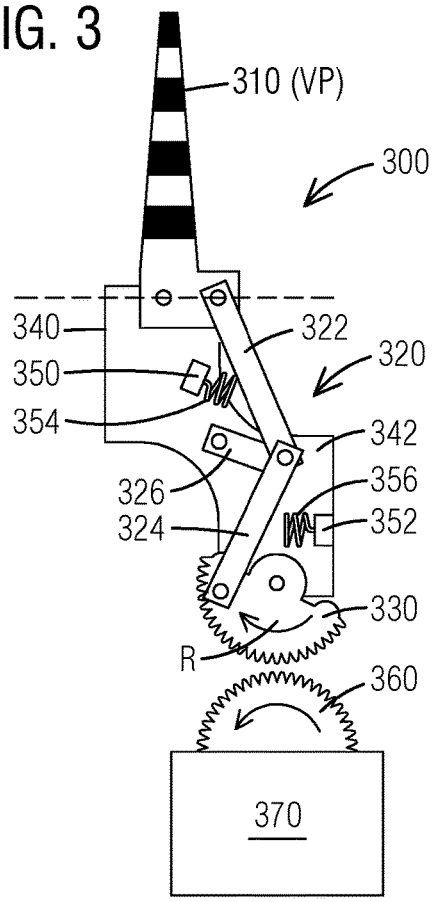
FIG. 3 illustrates a first front view of a crossing gate mechanism in accordance with an exemplary embodiment of the present disclosure.
Figure 4:
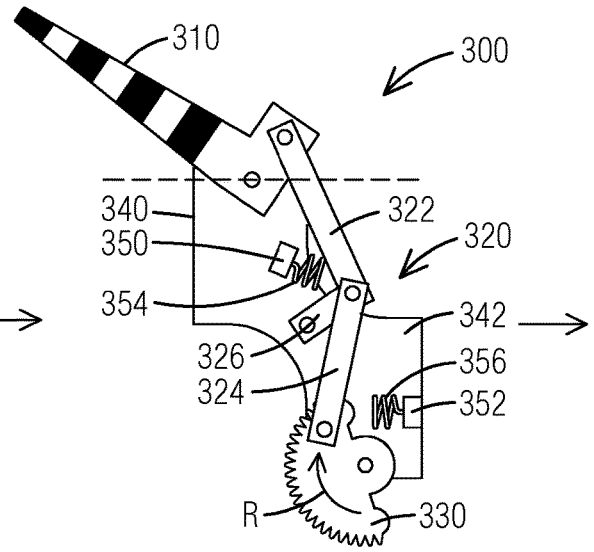
FIG. 4 illustrates a second front view of a crossing gate mechanism in accordance with an exemplary embodiment of the present disclosure.
Figure 5:
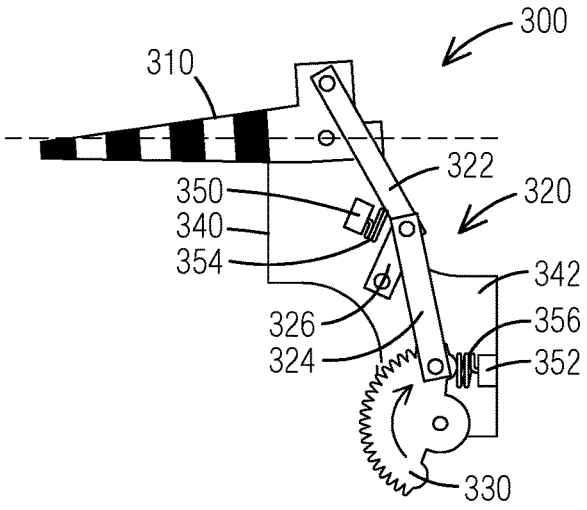
FIG. 5 illustrates a third front view of a crossing gate mechanism in accordance with an exemplary embodiment of the present disclosure.
Figure 6:
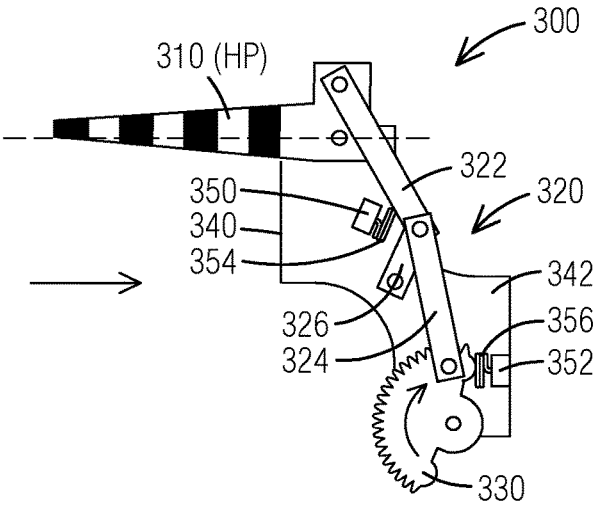
FIG. 6 illustrates a fourth front view of a crossing gate mechanism in accordance with an exemplary embodiment of the present disclosure.

FIG. 3 illustrates crossing gate arm 310 in a vertical position VP, where the crossing gate arm 310 is lifted and pedestrians and/or vehicles can cross railroad track(s). FIG. 4 and FIG. 5 illustrate intermediate positions of the crossing gate arm 310, where the gate arm 310 moves from the vertical position VP to the horizontal position HP or vice versa. FIG. 6 illustrates the crossing gate 310 in the horizontal position HP, where the gate arm 310 is descended and pedestrians and vehicles cannot cross the railroad track(s). It should be noted that the components of FIG. 3, FIG. 4, FIG. 5 and FIG. 6 are illustrated schematically and are not drawn to scale, in particular are not drawn to scale in relation to each other.

In an exemplary embodiment, the crossing gate mechanism 300 comprises a linkage 320 including gear 330. The linkage 320 is operably coupled to a crossing gate arm 310. In our example, only the crossing gate arm 310 is shown, but the gate mechanism 300 may be configured to be coupled to and operate more than one crossing gate arm 310, for example two crossing gate arms, as illustrated for example in FIG. 2.

The crossing gate arm 310 is movable between a vertical position VP, illustrated in FIG. 3, and a horizontal position HP, illustrated in FIG. 6, via the linkage 320. The linkage 320 is in a first position when the crossing gate arm 310 is in the vertical position VP, and the linkage 320 is in a second position when the crossing gate arm 310 is in the horizontal position HP. The linkage 320 in the second position mechanically locks the crossing gate arm 310 in the horizontal position HP as illustrated for example in FIG. 6. By mechanically locking the crossing gate arm 310 in the horizontal position, the gate arm 310 cannot be manually lifted, for example by a pedestrian, which increases safety for pedestrians and vehicles at a grade crossing.

The linkage 320 comprises an over-center linkage. In particular, the gear 330 of the linkage 320, when in operation, rotates over-center when the crossing gate arm 310 moves from the vertical position VP to the horizontal position HP. The direction of rotation of the gear 330 is illustrated by arrow R.

In an example, the linkage 320 comprises multiple components, such as for example a first connecting member 322 rotatably coupled at a first end to the crossing gate arm 310, and a second connecting member 324 rotatably coupled at a first end to the gear 330. The first and second connecting members 322, 324 are rotatably coupled to each other at their respective second ends. The linkage 320 comprises a third connecting member 326 which provides stability and support for the first and second connecting members 322, 324. The third connecting member 326 is rotatably coupled to a stationary part of the mechanism 300, such as for example a housing 340, and further coupled to the connecting point where the second ends of the first and second connecting members 322, 324 are coupled to each other.

The gear 330 is configured as segment gear and not as a full circular or round gear. For example, the gear 330 can be configured as half gear, wherein teeth of the gear 330 extend over a range of about 180°. However, the segment gear 330 may comprise other configurations, for example may extend with teeth over a range of up to 270°.

The crossing gate mechanism 300 further comprises housing 340, wherein the linkage 320 is positioned in the housing 340. A first structural element 350 and a second structural element 352 are arranged on an inner sidewall 342 of the housing 340. The structural elements 350, 352 can be fixed elements which serve as stopping point for the gear 330 and/or linkage 320. In an example, the structural elements 350, 352 are configured as spring buffers and each comprise for example a spring 354, 356. The second structural element 352 serves as stopping point for the gear 330. The first structural element 350 provides a resting location for the linkage 320 in an unpowered descent of the crossing gate arm 310.

In the first position of the linkage 320, the gate arm 310 is in the vertical position VP (see FIG. 3). The second connecting member 324, which is coupled to the segment gear 330, is not in a maximum stroke position which is considered "center". When the gear 330 rotates clockwise, as shown by arrow R, see FIG. 4, the second connecting member 324 will reach the maximum stroke position and is in center and in a vertical position. As the second connecting member 324 continues to rotate clockwise, the member 324 moves past the center position, i.e. over-center, see FIG. 5 and FIG. 6. In the over-center position, which corresponds to the second position of the linkage 320, the linkage 320 mechanically locks the gate arm 310 in the horizontal position HP, because a force that pushes the gate arm 310 trying to lift the gate arm 310 cannot operate or "back-drive" the mechanism. Instead, the segment gear 330 will hit the second structural element 352 which serves as a fixed stop. In order to lift and "unlock" the gate arm 310, the gear 330 must be rotated in the correct direction to remove the physical barrier. The correct direction is counterclockwise (the opposite direction of the arrow R).

The mechanism 300 with the linkage 320 and gear 330 is operated and powered by a gear train 360 and an electric motor 370. The gear train 360 can comprise one or more stages (gears) operably coupled to the electric motor 370. It should be noted that the gear train 360 and electric motor 370 are only shown schematically.

The described mechanism 300 is unique in that by rotating the gear 330 over-center to turn the gate arm 310 to the horizontal position HP with the gear 330 resting against element 352, any attempted lifting of the gate arm 310 results in the gear 330 driving into structural element 352 and therefore mechanically locking the gate arm 310 in the downward horizontal position HP. For the purposes of the figures, specifically FIG. 5, the 'droop' of the gate arm 310 below horizontal is exaggerated to demonstrate the principle when in practice it would be unnoticeable. The first structural element 350 equipped with spring buffer (spring 354) acts as the resting location for an unpowered descent of the gate arm 310 and also provides a force to ensure the gate arm 310 does not return to the 'droop' state once torque is removed from the gear 330. In a powered descent, the gate arm 310 effectively comes to a balanced rest between first structural element 350 and second structural element 352.

The mechanism 300 provides passive latching of the gate arm(s). If the gate arm(s) is/are lowered without power, the gate will sit against the spring 354 of the first structural element 350, intentionally not latching the crossing gate arm 310 so that emergency services may raise the gate arm 310 if needed. If the crossing needs to remain closed for a long period of time, authorized personnel may manually advance the mechanism to latch so that a pedestrian would not be able to lift the arm(s). Additionally, if the gate were to lose power once lowered and latched, it does not release the latching mechanism and will remain held in the down position (horizontal position) until powered up or manually raised. The mechanism 300 may be overridden by authorized personnel by manually advancing the internal gearing, but this is secured from the public.

In another exemplary embodiment, the mechanism 300 may be accomplished with a traditional cam profile. A cam is a rotating or sliding piece in a mechanical linkage used for transforming rotary motion into linear motion. For example, instead of gear 330 a cam profile may be used together with a cam follower producing reciprocating motion. The cam follower may be powered by an electric motor, such as for example motor 370.

The invention claimed is:

1. A crossing gate mechanism comprising:

a linkage operably coupled to a crossing gate arm, a housing, the linkage being positioned in the housing, wherein the crossing gate arm is movable between a vertical position and a horizontal position via the linkage, wherein the linkage is in a first position when the crossing gate arm is in the vertical position and in a second position when the crossing gate arm is in the horizontal position, wherein the linkage in the second position mechanically locks the crossing gate arm in the horizontal position, wherein the linkage comprises a gear that is configured as a segment gear, wherein teeth of the segment gear extend over a range of about 180°, wherein a first spring buffer is arranged on an inner sidewall of the housing and serves as a stopping point for the segment gear when the crossing gate arm is in the horizontal position, and wherein a second spring buffer is arranged on the inner sidewall of the housing and provides a resting location for the linkage in an unpowered descent of the crossing gate arm, wherein the linkage comprises a first connecting member rotatably coupled at a first end to the crossing gate arm and a second connecting member rotatably coupled at a first end to the gear, wherein the first connecting member and the second connecting member are coupled to each other at a connecting point at respective second ends, and further comprising a third connecting member connected at a first end to a stationary part and at a second end to the connecting point of the first and second connecting members.

2. The crossing gate mechanism as claimed in claim 1, wherein the linkage comprises an over-center linkage.

3. A railroad crossing gate comprising:

a crossing gate arm, and a gate mechanism with a linkage operably coupled to the crossing gate arm, a housing, the linkage being positioned in the housing, wherein the crossing gate arm is movable between a vertical position and a horizontal position via the linkage, wherein the linkage is in a first position when the crossing gate arm is in the vertical position and in a second position when the crossing gate arm is in the horizontal position, wherein the linkage in the second position mechanically locks the crossing gate arm in the horizontal position, wherein the linkage comprises a gear that is configured as a segment gear, wherein teeth of the segment gear extend over a range of about 180°, wherein a spring buffer is arranged on an inner sidewall of the housing and serves as a stopping point for the segment gear when the crossing gate arm is in the horizontal position, and wherein a second spring buffer is arranged on the inner sidewall of the housing and provides a resting location for the linkage in an unpowered descent of the crossing gate arm, wherein the linkage comprises a first connecting member rotatably coupled at a first end to the crossing gate arm and a second connecting member rotatably coupled at a first end to the gear, and wherein the first connecting member and the second connecting member are coupled to each other at a connecting point at respective second ends, and further comprising a third connecting member connected at a first end to a stationary part and at a second end to the connecting point of the first and second connecting members.

4. The railroad crossing gate as claimed in claim 3, wherein the linkage comprises an over-center linkage.

5. The railroad crossing gate as claimed in claim 3, wherein the gate mechanism is powered by an electric motor and gear train.

6. The railroad crossing gate as claimed in claim 3, wherein the crossing gate arm comprises a pedestrian gate arm or a vehicle gate arm.

7. The railroad crossing gate as claimed in claim 3, wherein the crossing gate arm comprises a pedestrian gate arm, and wherein the railroad crossing gate further comprises a vehicle gate arm, wherein the gate mechanism is configured to operate both the pedestrian gate arm and vehicle gate arm.

* * * * *